US005230385A

United States Patent [19]

Dinatale

[11] Patent Number: 5,230,385

[45] Date of Patent: Jul. 27, 1993

[54] PORTABLE RAKE HEAD ATTACHMENT FOR A GOLF CLUB

[76] Inventor: Regis C. Dinatale, 600 Northern Way, Unit 1701, Winter Springs, Fla. 32708

[21] Appl. No.: 932,606

[22] Filed: Aug. 20, 1992

[51] Int. Cl.[5] ..... A63B 57/00

[52] U.S. Cl. ..... 172/378; 172/750; 56/400.04; 273/32 B; 273/162 F

[58] Field of Search ..... 172/378, 380, 371, 438, 172/749, 750; 56/400.01, 400.04; 273/32 B, 162 F, 32 F; 294/19.2; 403/289, 290

[56] References Cited

U.S. PATENT DOCUMENTS

| | | | |
|---|---|---|---|
| D. 274,118 | 6/1984 | Cochrane | D8/13 |
| 2,721,755 | 10/1955 | Walner | 56/400.19 X |
| 3,654,754 | 4/1972 | Scoggin, Jr. et al. | 172/378 X |
| 3,870,300 | 3/1975 | Amendola | 56/400.04 X |
| 4,102,405 | 7/1978 | Carman | 172/378 |
| 4,216,831 | 8/1980 | Ritchie | 172/380 |
| 4,224,786 | 9/1980 | Langlie et al. | 56/400.01 |
| 4,774,804 | 10/1988 | Sands | 56/400.04 |
| 4,871,029 | 10/1989 | Rosin | 172/378 |
| 5,012,872 | 5/1991 | Cohn | 172/380 |

*Primary Examiner*—Randolph A. Reese
*Assistant Examiner*—Christopher J. Novosad
*Attorney, Agent, or Firm*—Julian C. Renfro

[57] ABSTRACT

A rake head attachment for raking the sand of a trap, designed for being removably mounted upon the grip of the shaft of a golf club. This rake head attachment comprises an elongate support member, from a lower portion of which a plurality of rake teeth extend substantially perpendicularly downwardly in a coplanar array. The upper portion of the support member is enlarged, with a handle-receiving socket defined in a central part thereof, with the central axis of the socket being generally perpendicular to the plane of the teeth. The socket has elongate members of springy, flexible material of sufficient length as to collectively define a socket of sufficient depth as to tightly and firmly receive a substantial portion of the end of the grip. The members close around the end of the inserted grip so as to grasp such end sufficiently tightly as to enable the rake teeth of the attachment to be pulled through the sand of the trap. The attachment is thereafter readily removable by sharply pulling the shaft of the club while restraining the attachment. Other features include a hanger on one end of the attachment so that when not in use, the golfer may carry the attachment on his belt or golf bag. A scraper may be utilized on the attachment opposite the hanger, to enable the golfer to remove mud from his shoe or club head. The handle may additionally serve as a grip rest.

15 Claims, 2 Drawing Sheets

PORTABLE RAKE HEAD ATTACHMENT FOR A GOLF CLUB

BACKGROUND OF THE INVENTION

It is well known that most golfers, including professionals, occasionally find themselves in a sand trap. It is also known that golf etiquette requires a player to fill and smooth his footprints and depressions left in the sand after he has hit a golf ball out of the sand trap. In order to accomplish this, many golf courses may leave a rake or the like in the vicinity of the sand traps. Unfortunately, these rakes tend to disappear, which not only adds substantial cost to the operation of the golf course, but also makes it quite difficult for a player to properly restore the surfaces of the sand trap.

In an attempt to alleviate this problem, many different configurations of rakes have been proposed in the past, often involving a rake head adapted to be connected to the end of the golf club. One such rake head is U.S. Pat. No. 2,721,755 to Walner. The Walner rake head appears to be very similar in size to a standard rake and is adapted to be secured to the handle portion of the golf club. When removed from the golf club, however, the Walner rake head is relatively large, thereby making it very difficult and inconvenient for a golfer to carry it around with him.

U.S. Pat. No. 3,870,300 to Amendola shows a golf tee holder which holds a row of six or seven golf tees and also includes a means for securing the same to the handle of the golf club. While the golf tee holder of Amendola can function as a rake and is smaller and more easily carried about than the earlier-mentioned rake, Amendola's device appears to be so small as to be relatively inefficient for raking purposes. Also, the removal of tees from this rakehead decreases its effectiveness as a rake.

U.S. Pat. No. 4,216,831 to Ritchie attempts to improve on both Walner and Amendola by providing a collapsible rake head which is smaller than Walner and, therefore, allegedly easier to carry. Also, Ritchie's rake head is larger than Amendola's, so that it can more efficiently function as a rake. The Ritchie device includes a center mounting bracket and a pair of pivotally secured rake blades mounted on either side of the mounting bracket. Such rake blades are operable between an open position in which they can function as a rake, and a closed position wherein the blades are rotated upwardly for storage or carrying.

Although Ritchie solves some of the problems of the Walner and Amendola patents, it creates additional problems, and by way of example, when the rake head of Ritchie is folded into its collapsed position, the two rake blade halves are spaced apart from each other with the teeth extending outwardly in opposite directions. Because of the width of the collapsed rake head and the protruding rake teeth, it becomes difficult to slip the collapsed rake head into a golfer's pocket and it is also difficult to carry the same in a golf bag. Furthermore, when utilizing any rake, it is to be realized that there are upward forces asserted on the sides of the rake head. Since the Ritchie device collapses by folding the two blade halves upwardly, his rake head may tend to collapse when the same is in use.

This present invention will be seen to relate to a rake head of a type highly suitable for temporary attachment to the grip of a golf club, that is a distinct improvement over the above-mentioned prior art devices, as well as others of this general type.

SUMMARY OF THE INVENTION

A rake head attachment for raking the sand of a trap in accordance with this invention is designed for being removably mounted on the grip of a golf club shaft, on the end of the shaft that is remote from the club head. My novel rake head attachment comprises an elongate support member having an upper portion and a lower portion, and a plurality of rake teeth extending downwardly from the lower portion of the support member in a coplanar, evenly spaced array. The upper portion of the support member tapers inwardly and upwardly from comparatively thin ends toward an enlarged central part, with a grip-receiving socket being disposed in such central part. The central axis of the socket is generally perpendicular to the plane of the rake teeth, and this socket is represented by a plurality of elongate fingers or members disposed in a circular array. Importantly, these fingers are made of springy, flexible material, with the resilience of this material being such that after being moved out of their normal position, the fingers promptly return to such normal position. The outer ends of the fingers flare slightly outwardly and normally define a circle slightly smaller than the diameter of the somewhat enlarged grip end of the club. The fingers are long enough so as to collectively define a socket of sufficient depth as to tightly and firmly receive a substantial portion of the grip end of the club.

The outer ends of the fingers, upon being brought into contact with the grip end of the handle, move outwardly as a group so as to admit the somewhat enlarged grip end of the handle, with the fingers thereafter closing around the grip end so as to tightly grasp it. It is to be understood that the fingers hold the enlarged grip end sufficiently tightly as to enable the teeth of the rake to be pulled through the sand of the trap without the attachment falling off. After use, the attachment is removable by sharply pulling the handle while restraining the attachment.

Advantageously, I may provide a hook or clip on the side of my rake head attachment, so after removal from the grip of the golf club, the attachment may be hooked in an out-of-the-way location on the golfer's belt or golf bag, so as to be readily available for the next use. Furthermore, I may utilize a small scraper device on one end of my novel rake head attachment. In such event, the aforementioned hook or clip may also function as one part of a handle-like portion to be grasped by the golfer at the time he uses the scraper to scrape hardened mud, for example, from his shoe or from the head end of one of his clubs.

It is therefore to be seen that a principal object of my invention is to provide a lightweight and highly portable attachment that may be removably mounted on the end of the grip of a golf club, and at such time used in an effective manner in order that the golfer can restore the condition of a sand trap by a raking effort.

It is another object of my invention to provide a lightweight and highly effective attachment that may be readily inserted upon the grip of the handle of a golf club, and used quite effectively in the raking of a sand trap, and thereafter immediately removed.

Still another object of this invention is to provide a rake head attachment for raking the sand of a trap, comprising a low cost, one-piece attachment that is portable, attractive in appearance, and highly effective for use on the end of the grip of a golf club, for raking the sand of a trap so as to prepare it for the next user, with such attachment being thereafter readily removable from the handle of the golf club.

Yet still another object of this invention is to provide a rake head attachment that on the one hand is sturdy enough for use in raking a trap, but on the other hand is of such lightweight construction and highly appropriate configuration as not to be burdensome for the golfer to carry, either hooked to his belt or to the edge of his golf bag.

Still another object of this invention is to provide a portable rake head attachment having a scraper on one end, such that this device can enable the golfer to quickly remove mud from his shoe or club head.

These and other objects, features, and advantages will be more apparent from a study of the appended drawings.

DETAILED DESCRIPTION

Figures 1, 2:
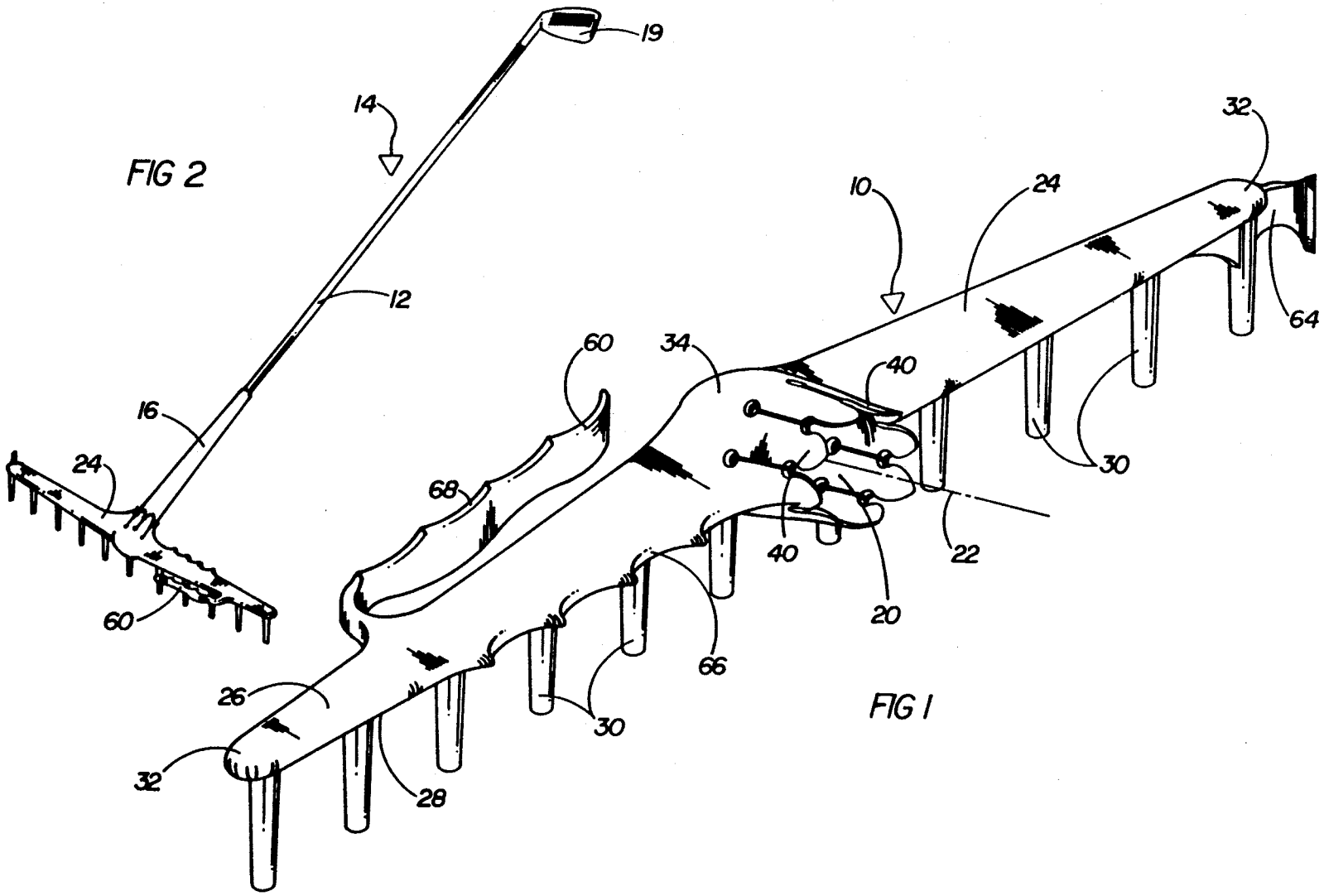
FIG. 1 is a perspective view of a preferred embodiment of a rake head attachment in accordance with my invention, with this view illustrating a centrally disposed socket for receiving the grip end of a golf club, with such socket being defined by a plurality of elongate, flexible teeth utilized in a circular array.
FIG. 2 is a view to a smaller scale of a rake head attachment in accordance with this invention, with this attachment having been removably applied to the somewhat enlarged end of the grip of a golf club, remote from the head of the club.

From initial reference to FIG. 1, it is to be seen that in accordance with this invention, I have provided a portable rake head attachment 10 to be utilized for raking the sand of a trap, being designed for being removably mounted on the end of the shaft 12 of a golf club 14, and more particularly, to the grip 16 of the club. Such a usage of my rake head attachment is to be seen in FIG. 2, depicting my attachment 10 in its operative position, in which the attachment 10 is utilized on the grip end of the shaft 12, which of course is the end of the shaft remote from the club head 19.

It is to be understood that the attachment 10 is designed to be readily inserted upon the somewhat enlarged end 18 of the shaft, as will be discussed hereinafter in conjunction with FIG. 5. As a result of this advantageous arrangement, the instant rake head attachment 10 can be readily utilized for raking the sand of a trap after the play has been completed. After such use, the attachment 10 is then readily removed from the grip of the golf club and hooked to the golfer's belt or golf bag.

Returning to a further consideration of FIG. 1, it is to be seen that the attachment 10 comprises a central socket 20 disposed in the elongate support member 24, with the support member 24 having an upper portion 26 and a lower portion 28. A plurality of rake teeth 30 extend essentially perpendicularly downwardly from the lower portion 28 of the elongate support member 24, and reside in a coplanar, evenly spaced array. The lower edges of the teeth 30 are preferably disposed in a straight line, but this is not an absolute requirement. The teeth 30 may be spaced closely enough together as to enable a golf ball to be retrieved.

It will be noted from FIG. 1 that the upper portion 26 of the elongate support member 24 tapers inwardly and upwardly from comparatively thin ends 32 toward the enlarged central part 34, wherein the centrally disposed handle-receiving socket 20 is defined. I regard the central axis 22 of the socket 20 as being generally perpendicular to the plane of the teeth 30. However, I utilize the terminology "generally perpendicular" in a broad sense in this instance, so as to include the central axis 22 being inclined upwardly a bit, so as to define an obtuse angle with the plane of the rake teeth 30.

It is important to note that the central socket 20 located in the central part of the member 24 is represented by a plurality of elongate fingers or members 40 disposed in a circular array, so as to define the socket 20. The socket 20 may be noted from FIGS. 3, 4 and 5, and it also may be regarded as being a club holding sleeve. The fingers 40 are made of springy, flexible material that has the characteristic of returning to the original position when a disturbing or distorting force is removed. In other words, the elongate fingers 40 are made of resilient material. It will be noted from FIG. 4 that in this instance, the fingers 40 are shown in their contracted or minimal diameter positions.

Figures 3, 4, 5:
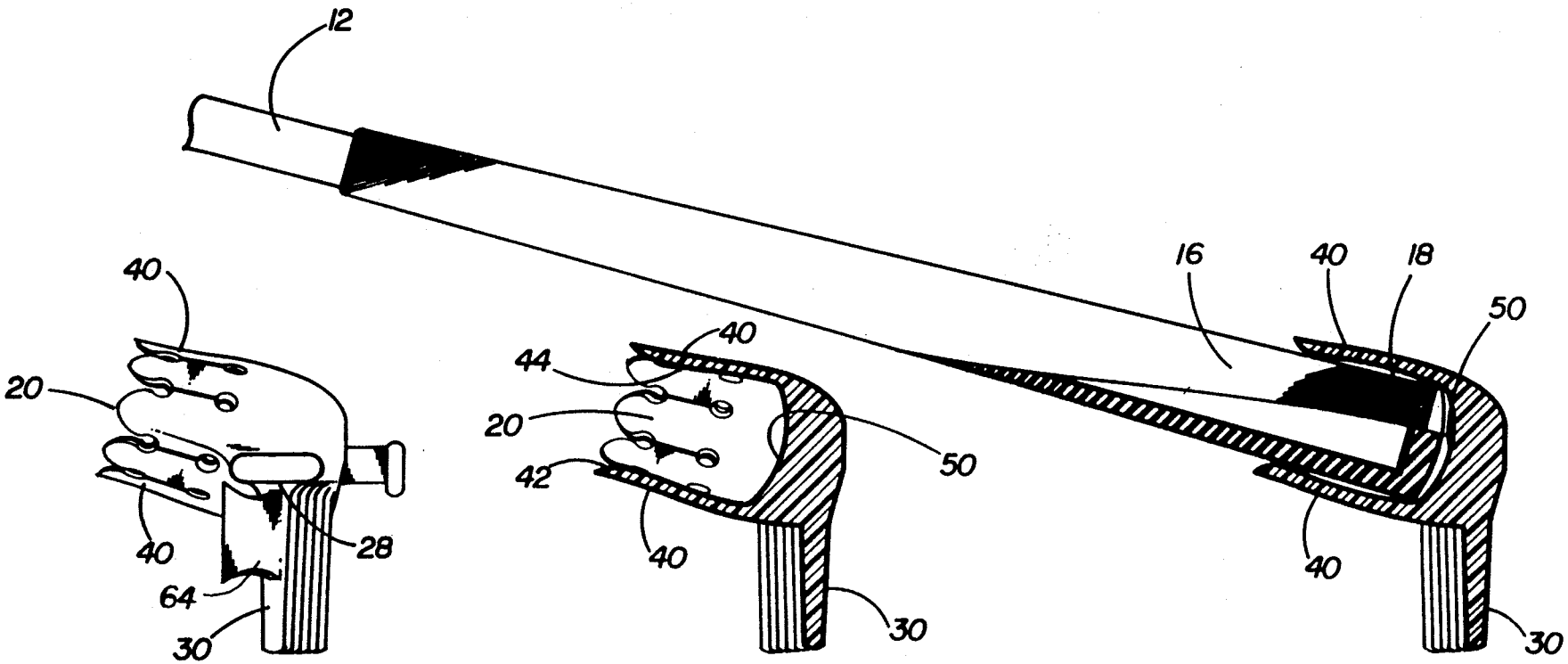
FIG. 3 is a side-elevational view of the socket disposed in a central portion of my golf club attachment, with the flexible, elongate fingers defining the socket being shown in full detail.
FIG. 4 is a view similar to FIG. 3 but providing a cross-sectional view of the socket utilizing flexible fingers configured to closely receive the grip end of a golf club, with the fingers in this instance shown in their somewhat contracted positions.
FIG. 5 is a view generally similar to FIG. 4 but here revealing the end of the grip of the golf club received in the centrally disposed socket defined by the elongate fingers.

It will be noted, particularly from FIGS. 3 and 4, that the outer ends 42 of the fingers 40 flare slightly outwardly, with the inner surfaces 44 of the outer ends of the fingers 40 normally defining a circle slightly smaller than the diameter of the somewhat enlarged end 18 of the grip 16. As previously mentioned, the fingers or members 40 are of elongate configuration, and these fingers possess sufficient length as to collectively define a recess portion 50 of the socket 20. The recess 50 is of sufficient depth so as, on occasion, to tightly and firmly receive a substantial portion of the enlarged end 18 of the grip 16; note FIG. 5.

It is to be noted that the inner surfaces 44 of the outer ends 42 of the fingers 40, upon being brought into contact with the enlarged end 18 of the grip 16, move outwardly as a group from their contracted positions, so as to admit the somewhat enlarged grip end. As will be noted from FIG. 5, at least an inch but preferably somewhat more than an inch of the grip 16 enters the inner recess 50 of the socket 20. Thereafter, the fingers 40 close around the enlarged grip end 18 of the shaft so as to grasp the grip sufficiently tightly as to enable the rake teeth 30 to be pulled through the sand of the trap, such that the trap can be restored to its pre-existing condition.

After the raking procedure has been completed, the attachment 10 is thereafter removed from the shaft by sharply pulling the shaft 12 of the golf club while restraining the attachment 10.

For the convenience of the golfer, I provide a member 60 of generally hook-shape configuration, with the length of the member 60 extending substantially parallel to the front edge of the elongate support member 24, and spaced therefrom to a slight extent; note FIG. 1.

The member 60 is on one side of the central socket 20, which is on the opposite end of the support member 24 from the scraper attachment 64. It will be noted that the scraper attachment 64 is at the far right-hand end of the elongate support member 24 as visible in FIG. 1.

A primary function of the member 60 is to create a hanger or hook enabling the golfer to hook the attachment 10 at some out-of-the-way position on his belt, or on his golf bag, thus leaving his hands free to continue the golf game. It is thus to be seen that my novel rake head attachment is highly portable, while at the same time being conveniently available to the golfer when next needed.

Because the member 60 is substantially flat and of tangible length, it may additionally function as a portion of a handle that can be grasped when the user wishes to utilize the scraper attachment 64 for removing hard mud or the like from his shoe or from one or more of his clubs. The hanger member 60 serves to provide additional width, so that the user can best grip or grasp the support member 24 when using the scraper.

For the comfort and convenience of the golfer, I may utilize some finger-receiving indentations 66 on the opposite side of the support member 24 from the hanger member 60, to facilitate the golfer grasping the attachment 10 at the time he is using the scraper 64. It is therefore to be seen that the member 60 may be regarded as a combination hanger and handle.

There are two separate sets of indentations on my novel rake head attachment. One set, indentations 66, on the rear edge of the elongate support member 24, are intended to receive the fingers of the user, when he or she is using the scraper portion 64 for removing mud or the like form the club face or from the golfer's shoes.

The other set of indentations, which are indentations 68, are on the upper edge of the hanger member 60. The indentations 68 are intended to serve as a club rest when a club is placed on damp ground. It is well known that golfers do not want the grip portion of a club to get wet, so when leaving the sand trap, and approaching the putting surface, clubs not in use at this particular time may be placed on the ground, but with the grip portion of the club or clubs resting in the indentations 68.

It should now be apparent that I have provided a rake head attachment that can be readily installed upon the end of the grip of a golf club at such time as a trap is to be raked. As previously explained, the elongate fingers 40 readily receive the enlarged grip end 18 of the handle of the golf club, and grasp the grip sufficiently tightly that the rake teeth 30 of my novel device can be effectively utilized for raking the sand of the trap, thus restoring the trap to the proper condition for the next player. My attachment 10 is on the one hand sturdy, but on the other hand light enough so as to be regarded as highly portable. In other words, my golf club attachment is not particularly burdensome for the golfer to carry at such time as he has removed the attachment from the grip of the golf club and is ready to move on to the next hole.

As earlier pointed out, the member 60 not only serves as a convenient handle, but also its hook shape configuration enables my device to be hooked either over the golfer's belt, or over one edge of his golf bag.

I am not to be limited to any particular construction materials, but I have found that certain industrial plastics are strong enough as not to break during any normal or even vigorous use of my device. The plastic I prefer to use is polypropylene, but other sturdy plastics may do as well. As is obvious, my novel attachment may be readily manufactured in a wide range of colors.

I am also not to be limited to any particular dimensions, but one prototype of my attachment 10 was approximately 15 inches in overall length, with the rake teeth 30 being approximately 2½ inches long. In this same prototype the central socket or club holding sleeve was 1¾ inches long, and the combination hook and handle 60 was 3½ inches long.

I claim:

1. A rake head attachment for raking the sand of a trap, said rake head attachment designed for being removably mounted on the grip of the shaft of a golf club, said rake head attachment comprising an elongate support member having an upper portion and a lower portion, and a plurality of rake teeth extending downwardly from the lower portion of said support member in a coplanar array, the upper portion of said support member being enlarged, with a grip-receiving socket being disposed in a central part thereof, with the central axis of said socket being generally perpendicular to the plane of said teeth, said socket being represented by at least three evenly spaced, elongate members of springy, flexible material of sufficient length as to collectively define a circular socket of sufficient depth as to tightly and firmly receive a substantial portion of the end of the grip, with the members closing around the end of the inserted grip so as to tightly grasp such end, said members grasping the end of the grip sufficiently tightly as to enable the rake teeth of the attachment to be pulled through the sand of the trap, said attachment being thereafter removable by sharply pulling the shaft of the club while restraining said attachment.

2. The attachment as recited in claim 1 in which a hanger is defined adjacent one end of said attachment, so that when not in use, said attachment may be carried on the belt or golf bag of the golfer.

3. The attachment as recited in claim 2 in which said hanger comprises a series of indentations serving as a grip rest.

4. The attachment as recited in claim 1 in which a scraper is defined on one end of said attachment, so that when said attachment is not installed on the grip of a golf club, said scraper may be used for removing mud or the like from the shoe or club of the golfer.

5. The attachment as recited in claim 1 in which a scraper is defined on one end of said attachment, and a combination hanger and handle adjacent the other end, so that when said attachment is not installed on the grip of a golf club, said handle may be grasped by the golfer, and the scraper used for removing mud or the like from the shoe or club of the golfer.

6. A rake head attachment for raking the sand of a trap, said rake head attachment designed for being removably mounted on the grip end of the shaft of a golf club, said rake head attachment comprising an elongage support member having an upper portion and a lower portion, and a plurality of rake teeth extending downwardly from the lower portion of said support member in a coplanar, substantially evenly spaced array, the upper portion of said support member being enlarged, with a grip-receiving socket being disposed in a central part thereof, with the central axis of said socket being generally perpendicular to the plane of said teeth, said socket being represented by at least three discrete, evenly spaced elongate members of springy, flexible material, with the outer ends of said members defining a circle slightly smaller than the diameter of the somewhat enlarged grip end of the golf club, said members being of sufficient length as to collectively define a closed-end socket of sufficient depth as to tightly and firmly receive a substantial portion of the end of the grip, the outer ends of said members, upon being brought into contact with the outer end of the grip, moving outwardly as a group so as to admit the somewhat enlarged end of the grip, with the members thereafter closing around the end of the grip so as to tightly grasp such end, said members grasping the end of the grip sufficiently tightly as to enable the rake teeth of the attachment to be pulled through the sand of the trap, said attachment being thereafter removable by sharply pulling the shaft of the club while restraining said attachment.

7. The attachment as recited in claim 6 in which a hanger is defined adjacent one end of said attachment, so that when not in use, said attachment may be carried on the belt or golf bag of the golfer.

8. The attachment as recited in claim 7 in which said hanger comprises a series of indentations serving as a grip rest.

9. The attachment as recited in claim 6 in which a scraper is defined on one end of said attachment, so that when said attachment is not installed on the grip of a golf club, said scraper may be used for removing mud or the like from the shoe or club of the golfer.

10. The attachment as recited in claim 6 in which a scraper is defined on one end of said attachment, and a combination hanger and handle adjacent the other end, so that when said attachment is not installed on the grip of a golf club, said handle may be grasped by the golfer, and the scraper used for removing mud or the like from the shoe or club of the golfer.

11. A rake head attachment for raking the sand of a trap, said rake head attachment designed for being removably mounted on the grip end of the shaft of a golf club, on the end of the shaft remote from the club head, said rake head attachment comprising an elongate support member having an upper portion and a lower portion, and a plurality of rake teeth extending perpendicularly downwardly from the lower portion of said support member in a coplanar, substantially evenly spaced array, the upper portion of said support member tapering inwardly and upwardly from comparatively thin ends toward an enlarged central part, with a grip-receiving socket being disposed in such central part, with the central axis of said socket being generally perpendicular to the plane of said teeth, said socket being represented by a plurality of elongate fingers disposed in a circular array, said fingers being made of springy, flexible material, with the outermost ends of said fingers flaring slightly outwardly, the inner surfaces of said outermost ends of said fingers normally defining a circle slightly smaller than the diameter of the somewhat enlarged grip end of the shaft of the club, said fingers being of sufficient length as to collectively define a socket of sufficient depth as to tightly and firmly receive a substantial portion of the end of the grip, the outer ends of said fingers, upon being brought into contact with the outer end of the grip, moving outwardly as a group so as to admit the somewhat enlarged end of the grip, with the fingers thereafter closing around the end of the grip so as to tightly grasp such end of the grip, said fingers grasping the end of the grip sufficiently tightly as to enable the rake teeth of the attachment to be pulled through the sand of the trap, said attachment being thereafter removable by sharply pulling the shaft of the club while restraining said attachment.

12. The attachment as recited in claim 11 in which a hanger is defined adjacent one end of said attachment, so that when not in use, said attachment may be carried on the belt or golf bag of the golfer.

13. The attachment as recited in claim 12 in which said hanger comprises a series of indentations serving as a grip rest.

14. The attachment as recited in claim 11 in which a scraper is defined on one end of said attachment, so that when said attachment is not installed on the grip of a golf club, said scraper may be used for removing mud or the like from the shoe or club of the golfer.

15. The attachment as recited in claim 11 in which a scraper is defined on one end of said attachment, and a combination hanger and handle adjacent the other end, so that when said attachment is not installed on the grip of a golf club, said handle may be grasped by the golfer, and the scraper used for removing mud or the like from the shoe or club of the golfer.

* * * * *